US008585309B2

(12) United States Patent
Song

(10) Patent No.: US 8,585,309 B2
(45) Date of Patent: Nov. 19, 2013

(54) LIQUID MAKE-UP RECEPTACLE

(75) Inventor: Ho Suk Song, Bupyeong-gu (KR)

(73) Assignee: S&P World Ltd., Incheon (KR)

( * ) Notice: Subject to any disclaimer, the term of this patent is extended or adjusted under 35 U.S.C. 154(b) by 559 days.

(21) Appl. No.: 12/993,888

(22) PCT Filed: May 22, 2009

(86) PCT No.: PCT/KR2009/002716
§ 371 (c)(1),
(2), (4) Date: Jan. 6, 2011

(87) PCT Pub. No.: WO2009/142456
PCT Pub. Date: Nov. 26, 2009

(65) Prior Publication Data

US 2011/0110702 A1 May 12, 2011

(30) Foreign Application Priority Data

May 23, 2008 (KR) ..... 10-2008-0048055

(51) Int. Cl.
*A46B 17/04* (2006.01)

(52) U.S. Cl.
USPC ..... 401/269; 401/202

(58) Field of Classification Search
USPC ..... 401/202, 205, 206, 207, 262, 265, 266, 401/269, 270, 286
See application file for complete search history.

(56) References Cited

U.S. PATENT DOCUMENTS 5,018,894 A * 5/1991 Goncalves ..... 401/202
5,678,941 A * 10/1997 Nakajima ..... 401/205
7,125,189 B2 * 10/2006 Gueret ..... 401/202

* cited by examiner

*Primary Examiner* — David Walczak
(74) *Attorney, Agent, or Firm* — Lexyoume IP Meister, PLLC.

(57) ABSTRACT

A liquid cosmetic container, comprising: a housing which has an opening at one side and contains liquid materials in an inner space; a discharge portion, one end of which is coupled with the opening of the housing and the other end has discharge protrusions for discharging the materials; a shoulder which includes a body having a through-hole in the center, a lower insertion portion for coupling with the housing or the discharge portion and an upper insertion portion formed at the upper part of the body; a ring with a hollow body and a connecting portion coupled with the upper insertion portion of the shoulder at the lower part of the body; a cosmetic application member inserted into the ring and which has a through-hole where the discharge protrusions of the discharge portion are inserted; and a cap coupled with the shoulder portion.

15 Claims, 9 Drawing Sheets

LIQUID MAKE-UP RECEPTACLE

TECHNICAL FIELD

The present invention relates to a liquid make-up receptacle which is intended to hold liquid-phase materials. More particularly, the present invention relates to a liquid make-up receptacle which is equipped with a replaceable application member.

BACKGROUND ART

Typically, conventional liquid make-up receptacles have the shape of a tube, and are constructed so that materials are discharged by pressing the tube, and the discharged materials are applied to a user's hand or the like and then put on a desired portion.

Meanwhile, some liquid make-up receptacles are constructed so that a sponge or the like is attached to an outlet of a tube to come into direct contact with a desired portion. However, such make-up receptacles are problematic in that, when the sponge or the like becomes dirty, it must be replaced with a new one. The conventional product equipped with the sponge is problematic in that the sponge or the like is adhered using glue or the like, so that it is difficult and inconvenient for a user to replace the sponge with a new one.

In this case, the sponge and a sponge holder may be constructed to be replaceable so as to increase the ease of replacement. However, if a cap is coupled to the sponge holder, the sponge holder may unexpectedly become detached together with the cap because of a coupling force therebetween when the cap is opened.

DISCLOSURE

Technical Problem

Accordingly, the present invention has the following objects in order to solve the above problems occurring in the prior art.

First, an object of the present invention is to provide a liquid make-up receptacle, which allows an application member such as a sponge to be easily replaced with a new one.

Second, another object of the present invention is to provide a liquid make-up receptacle, which allows an application member and a ring into which the application member is seated to be replaced together with new ones.

Third, a further object of the present invention is to provide a liquid make-up receptacle, which prevents an application member and a ring into which the application member is seated from being detached by a cap when it is opened.

The objects of the present invention are not limited to the above-mentioned objects, and other objects can be clearly understood by those skilled in the art from the following description.

Technical Solution

In order to accomplish the above objects, the present invention provides a liquid make-up receptacle, including a housing having an opening at a first end thereof and holding liquid materials in an inner space thereof; a discharge part coupled at a first end thereof to the opening of the housing and having at a second end thereof a discharge protrusion to discharge the materials; a shoulder including a body having a hole in a center thereof, a lower seating portion provided on a lower portion of the body to be coupled to the housing or the discharge part, and an upper seating portion provided on an upper portion of the body; a ring including a hollow body and a connecting portion provided on a lower portion of the body and fastened to the upper seating portion of the shoulder; an application member seated in an application-member seating portion formed in the ring and having a through hole into which the discharge protrusion of the discharge part is inserted from below; and a cap coupled to the shoulder, whereby a load applied at a time of opening or closing the cap is not directly transmitted to the ring, thus preventing the ring from being detached together with the cap when the cap is opened.

In the liquid make-up receptacle according to the present invention, the body of the shoulder may include a cap seating portion having a stepped structure, an outer diameter of a lower end thereof may correspond to an outer diameter of the cap, and an outer diameter of an upper end thereof may correspond to an inner diameter of the cap.

In the liquid make-up receptacle according to the present invention, a depression member may be provided on either of an outer surface of an upper end of the shoulder and an inner surface of the cap which are in contact with each other, and a prominence member may be provided on a facing corresponding surface, so that the shoulder and the cap may be coupled to each other in a force-fitting manner. Further, the depression member and the prominence member may be discontinuously or continuously formed.

In the liquid make-up receptacle according to the present invention, threaded parts may be provided on the outer surface of the upper end of the shoulder and the inner surface of the cap which are in contact with each other, so that the shoulder and the cap may be coupled to each other in a threaded manner.

In the liquid make-up receptacle according to the present invention, an outer surface of the connecting portion of the ring may be inserted into and fastened to an inner surface of the upper seating portion of the shoulder, or an outer surface of the upper seating portion of the shoulder may be inserted into and fastened to an inner surface of the connecting portion of the ring.

In the liquid make-up receptacle according to the present invention, a depression member may be provided on either of the inner surface of the upper seating portion of the shoulder and the outer surface of the connecting portion of the ring which are in contact with each other, or on either of the outer surface of the upper seating portion of the shoulder and the inner surface of the connecting portion of the ring which are in contact with each other, and a prominence member may be provided on a facing corresponding surface, so that the shoulder and the ring may be coupled to each other in a force-fitting manner.

In the liquid make-up receptacle according to the present invention, threaded parts may be provided on the inner surface of the upper seating portion of the shoulder and the outer surface of the connecting portion of the ring which are in contact with each other, or on the outer surface of the upper seating portion of the shoulder and the inner surface of the connecting portion of the ring which are in contact with each other, so that the shoulder and the ring may be coupled to each other in a threaded manner.

In the liquid make-up receptacle according to the present invention, a diameter of the application member (500) may be formed to be a diameter of the application-member seating portion (420) of the ring (400) or less, so that a surface of the application member (500) may be adhered to the application-member seating portion (420) of the ring (400).

In the liquid make-up receptacle according to the present invention, a diameter of the application member (500) may be formed to be larger than a diameter of the application-member seating portion (420) of the ring (400), so that the application member (500) may be force-fitted into the application-member seating portion (420).

In the liquid make-up receptacle according to the present invention, a protrusion may be provided on either of an inner surface of the application-member seating portion of the body of the ring and an outer surface of the application member which are in contact with each other, and a groove may be provided in a facing corresponding surface, so that the application member may be coupled to the application-member seating portion of the ring in a fitting manner.

In the liquid make-up receptacle according to the present invention, the application member may be made of a soft material.

In the liquid make-up receptacle according to the present invention, the application member may have a circular or an elliptical cross-section, and the shoulder, the ring and the cap may have a shape which corresponds to a shape of the cross-section of the application member.

In the liquid make-up receptacle according to the present invention, the cap may include a projection protruding from an upper surface of an inner portion thereof, so that the projection may be inserted into the through hole of the application member when the cap is closed.

In the liquid make-up receptacle according to the present invention, the projection of the cap inserted into the through hole of the application member may block the discharge protrusion of the discharge part.

Advantageous Effects

According to the present invention, a liquid make-up receptacle is advantageous in that it enables the easy replacement of an application member independent of or together with a ring into which the application member is seated. Further, the liquid make-up receptacle is advantageous in that the ring and a shoulder are coupled to each other in a threaded manner or a force-fitting manner, so a coupling force therebetween is increased and attachment and detachment are easily performed. Furthermore, the liquid make-up receptacle is advantageous in that a cap and the shoulder are coupled while the cap and the ring are not directly coupled, so the ring is not detached with the cap when the cap is opened.

BEST MODE

The present invention provides a liquid make-up receptacle, including a housing having an opening at a first end thereof and holding liquid materials in an inner space thereof; a discharge part coupled at a first end thereof to the opening of the housing and having at a second end thereof a discharge protrusion to discharge the materials; a shoulder including a body having a hole in a center thereof, a lower seating portion provided on a lower portion of the body to be coupled to the housing or the discharge part, and an upper seating portion provided on an upper portion of the body; a ring including a hollow body and a connecting portion provided on a lower portion of the body and fastened to the upper seating portion of the shoulder; an application member seated in an application-member seating portion formed in the ring and having a through hole into which the discharge protrusion of the discharge part is inserted from below; and a cap coupled to the shoulder, whereby a load applied at a time of opening or closing the cap is not directly transmitted to the ring, thus preventing the ring from being detached together with the cap when the cap is opened.

Mode for Invention

Hereinafter, a liquid make-up receptacle according to the present invention will be described in detail with reference to the accompanying drawings.

Figure 1:
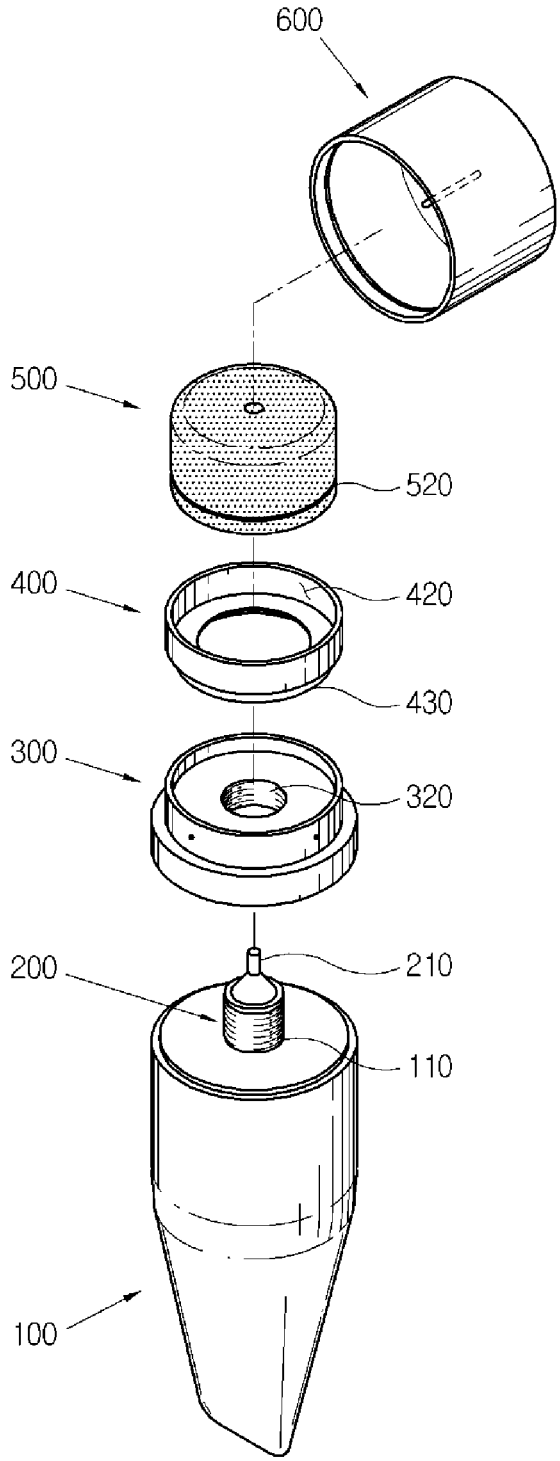
FIG. 1 is an exploded perspective view showing a liquid make-up receptacle, according to the present invention.
Figure 2:
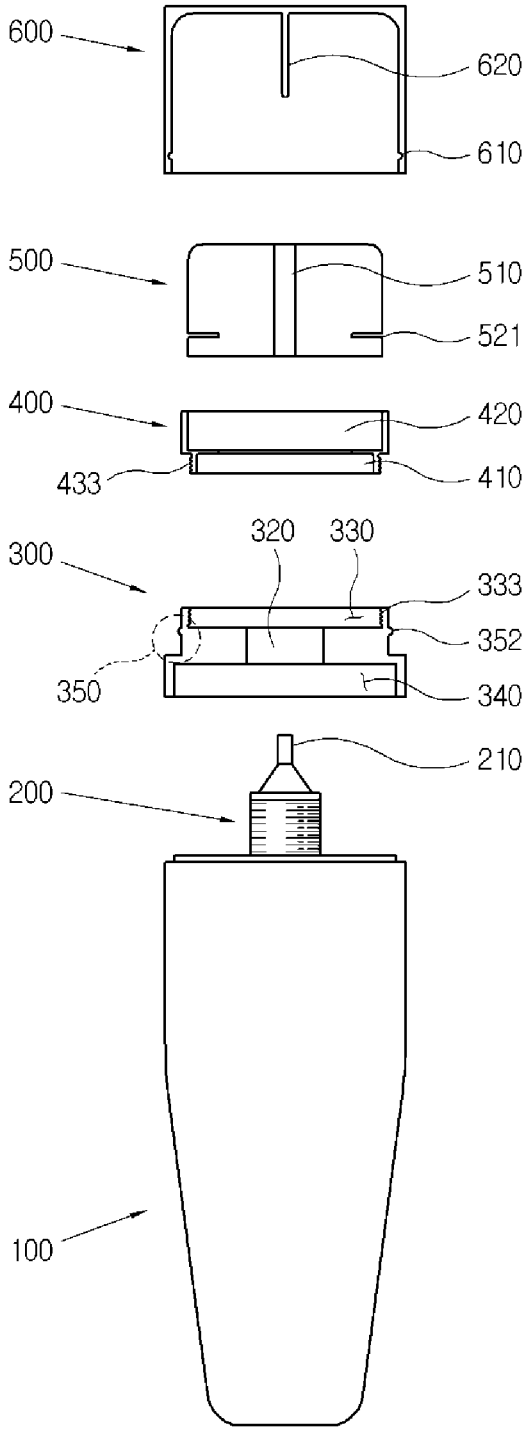
FIG. 2 is an exploded front view showing the liquid make-up receptacle of FIG. 1.
Figure 3:
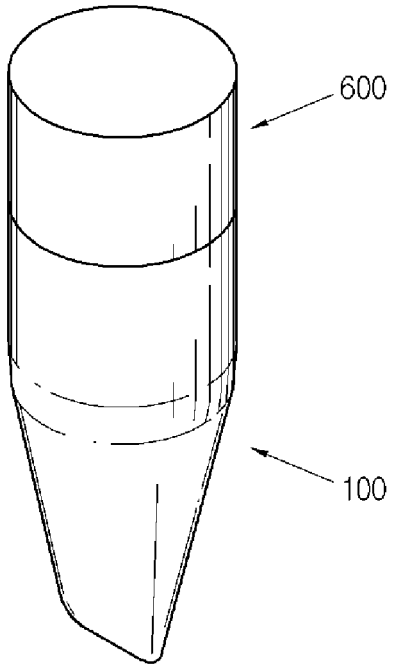
FIG. 3 is a view showing the assembled liquid make-up receptacle of FIG. 1.

FIG. 1 is an exploded perspective view showing a liquid make-up receptacle according to the present invention, FIG. 2 is an exploded front view showing the liquid make-up receptacle of FIG. 1, and FIG. 3 is a view showing the assembled liquid make-up receptacle of FIG. 1.

As shown in FIGS. 1 to 3, the liquid make-up receptacle according to the present invention includes a housing 100, a discharge part 200, a shoulder 300, a ring 400, an application member 500 and a cap 600.

In detail, the liquid make-up receptacle according to the present invention includes the housing 100 which has an opening 110 at one end thereof, and contains liquid materials in its inner space.

The liquid make-up receptacle according to the present invention includes the discharge part 200 which is coupled at one end thereof to the opening 110 of the housing 100, and has at the other end a discharge protrusion 210 to discharge the materials.

The liquid make-up receptacle according to the present invention includes the shoulder 300 including a body 310 which has a hole 320 in its center, a lower seating portion 340 which is provided on the lower portion of the body to be coupled to the housing 100 or the discharge part 200, and an upper seating portion 330 which is provided on the upper portion of the body.

The liquid make-up receptacle according to the present invention includes the ring 400 which has a hollow body 410, and a connecting portion 430 which is fastened to the upper seating portion 330 of the shoulder 300.

The liquid make-up receptacle according to the present invention includes the application member 500 which is seated into an application-member seating portion 420 formed in the ring 400, and has a through hole 510 into which the discharge protrusion 210 of the discharge part 200 is inserted from below.

The liquid make-up receptacle according to the present invention includes the cap 600 which is coupled to the shoulder 300. Thus, the liquid make-up receptacle according to the present invention prevents the load applied to open or close the cap 600 from being directly exerted on the ring 400, thus preventing the ring 400 from being detached together with the cap 600 when the cap 600 is opened.

The technical construction relationship between the shoulder 300 and the cap 600 according to the present invention will be described below.

That is, the liquid make-up receptacle according to the present invention is constructed so that the shoulder 300 is coupled to the cap 600. Various coupling structures may be used to couple them to each other. For the convenience of manufacture and that of a user, they are preferably coupled to each other in a threaded manner or a force-fitting manner using depression and prominence members.

Figure 6:
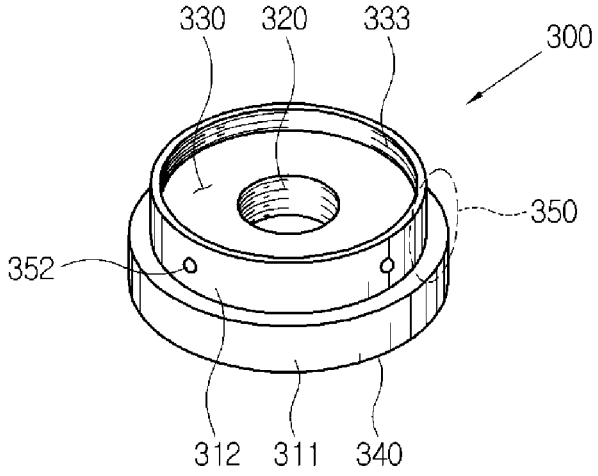
FIG. 6 is a perspective view showing a shoulder according to the present invention.
Figure 9:
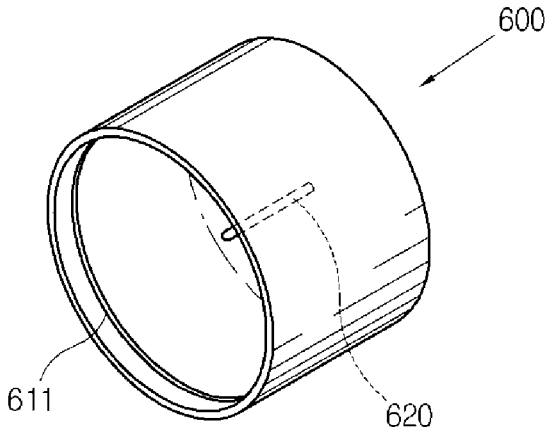
FIG. 9 is a perspective view showing a cap according to the present invention.

FIG. 6 shows an embodiment of the shoulder 300 according to the present invention, and FIG. 9 shows an embodiment of the cap 600 according to the present invention. In the case of the embodiment shown in FIG. 6, the body 310 of the shoulder 300 is provided with a stepped cap seating portion 350. The outer diameter of a lower end 311 of the body corresponds to the outer diameter of the cap 600, while the outer diameter of an upper end 312 of the body corresponds to the inner diameter of the cap 600.

In this embodiment, the coupling structure is formed on the upper end 312 of the shoulder 300, while the coupling structure is not formed on the lower end 311, so that a user can easily open or close the cap 600 with respect to the shoulder 300 using the coupling structure formed on the upper end 312 with the lower end 311 being held in his or her hand (see FIGS. 1 and 2).

Of course, the technical construction wherein the stepped structure is not provided on the lower end 311 and the upper end 312 and the coupling structure is formed on a side surface of the shoulder 300 falls within the scope of the embodiment of the present invention.

In the embodiment of the coupling structure, preferably, a depression member is formed on either of the outer surface of the upper end 312 of the shoulder 300 and the inner surface of the cap 600 which are in contact with each other, and a prominence member is formed on the other corresponding surface, so that the shoulder and the cap are coupled to each other in a force-fitting manner.

In the embodiment of FIG. 2, the prominence member 352 is formed on the cap seating portion 350 which is provided on the outer surface of the upper end 312 of the shoulder 300, and the depression member 611 is formed on the connecting portion 610 which is provided on the inner surface of the cap 600 to correspond to the prominence member.

In the liquid make-up receptacle according to the present invention, the depression member and the prominence member are preferably formed discontinuously or continuously.

As one example, as shown in FIG. 6, prominence members 352 are discontinuously formed on the outer surface of the upper end 312 of the shoulder 300. Further, as shown in FIG. 9, the depression member 611 is continuously formed on the connecting portion 610 which is provided on the inner surface of the cap 600.

Meanwhile, in the embodiment of the coupling structure, threaded parts may be formed on both contact surfaces, that is, the outer surface of the upper end 312 of the shoulder 300 and the inner surface of the cap 600 so as to be coupled to each other (not shown).

The technical construction relationship between the shoulder 300 and the ring 400 according to the present invention will be described below. The upper seating portion 330 is formed in the upper portion of the body 310 of the shoulder 300 according to the present invention. The ring 400 according to the present invention has the hollow body 410. The connecting portion 430 is provided on the lower portion of the body 410 to be fastened to the upper seating portion 330 of the shoulder 300.

That is, the upper seating portion 330 of the shoulder 300 is fastened to the connecting portion 430 of the ring 400. The fastening structure of the upper seating portion and the connecting portion may be formed as in the following embodiments.

According to the first embodiment, the size of the upper seating portion 330 of the shoulder 300 is formed to be larger than that of the connecting portion 430 of the ring 400, so that the outer surface of the connecting portion 430 of the ring 400 is inserted into and fastened to the inner surface of the upper seating portion 330 of the shoulder 300.

According to the second embodiment, the size of the connecting portion 430 of the ring 400 is formed to be larger than that of the upper seating portion 330 of the shoulder 300, so that the outer surface of the upper seating portion 330 of the shoulder 300 is inserted into and fastened to the inner surface of the connecting portion 430 of the ring 400.

Meanwhile, various fastening structures may also be applied to the first and second embodiments. In a detailed description, preferably, the depression member may be formed on either of the inner surface of the upper seating portion 330 of the shoulder and the outer surface of the connecting portion 430 of the ring which are in contact with each other, or on either of the outer surface of the upper seating portion 330 of the shoulder and the inner surface of the connecting portion 430 of the ring which are in contact with each other, while the prominence member may be formed on the other corresponding surface, so that the shoulder and the ring are coupled to each other in a force-fitting manner.

Further, threaded parts 333 and 433 may be preferably formed on both the inner surface of the upper seating portion 330 of the shoulder and the outer surface of the connecting portion 430 of the ring which are in contact with each other, or on both the outer surface of the upper seating portion 330 of the shoulder and the inner surface of the connecting portion 430 of the ring which are in contact with each other, so that the shoulder and the ring are coupled to each other in a threaded manner (see FIGS. 2 and 6).

The application member 500 according to the present invention is seated in the application-member seating portion 420 which is formed in the ring 400. According to the present invention, a structure wherein the application member 500 is seated into the application-member seating portion 420 of the ring 400 is not limited to a specific structure, and may be formed in various ways.

According to the first embodiment, the diameter of the application member 500 may be formed to be the diameter of the application-member seating portion 420 of the ring 400 or less, that is, may be formed to be almost equal to or slightly smaller than the diameter of the application-member seating portion, so that a surface of the application member 500, namely, a bottom surface and/or a side surface may be adhered to the application-member seating portion 420 of the ring 400 by an adhesive or the like.

According to the second embodiment, the diameter of the application member 500 may be formed to be larger than the diameter of the application-member seating portion 420 of the ring 400, so that the application member 500 may be force-fitted into the application-member seating portion 420.

According to the third embodiment, more preferably, a protrusion may be formed on either of the inner surface of the application-member seating portion 420 of the body 410 of the ring 400 and the outer surface of the application member 500 which are in contact with each other, and a groove may be formed on the other corresponding surface, so that the application member 500 may be fitted into the application-member seating portion 420 of the ring 400 so as to improve coupling strength or afford easy replacement.

Figure 7:
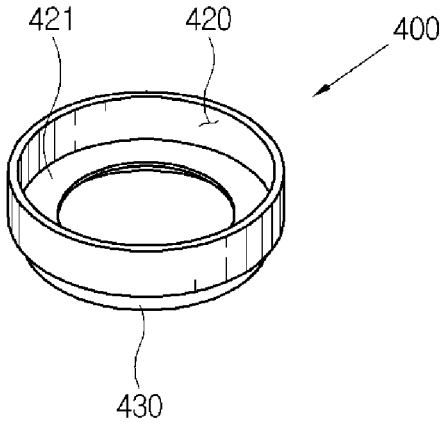
FIG. 7 is a perspective view showing a ring according to the present invention.
Figure 8:
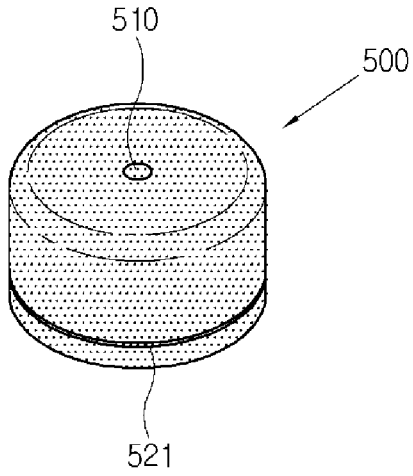
FIG. 8 is a perspective view showing an application member according to the present invention.

As one example of the third embodiment, a groove 521 may be formed in a predetermined portion of the outer surface of the application member 500 (see FIG. 8), and a protrusion 421 may be formed on the inner surface of the application-member seating portion 420 of the body 410 of the ring 400 (see FIG. 7), so that the application member may be coupled with the ring by fitting the protrusion 421 of the ring 400 into the groove 521 of the application member 500 (see FIG. 2)

The material of the application member 500 according to the present invention is not limited to a specific material, and may be made of a hard material. However, it is more preferable that the application member be made of a soft material in consideration of the sensation of touch or the dispersion of liquid materials.

Meanwhile, since the application member 500 according to the present invention is not limited to a specific cross-section, the application member may have various cross-sections or external profiles. As one embodiment, the application member 500 may have a circular or an elliptical cross-section.

Once the cross-section of the application member 500 has been determined, the shapes of components related to the application member 500, such as the shoulder 300, the ring 400 and the cap 600, may be preferably set to correspond to the cross-section of the application member 500.

Figure 4:
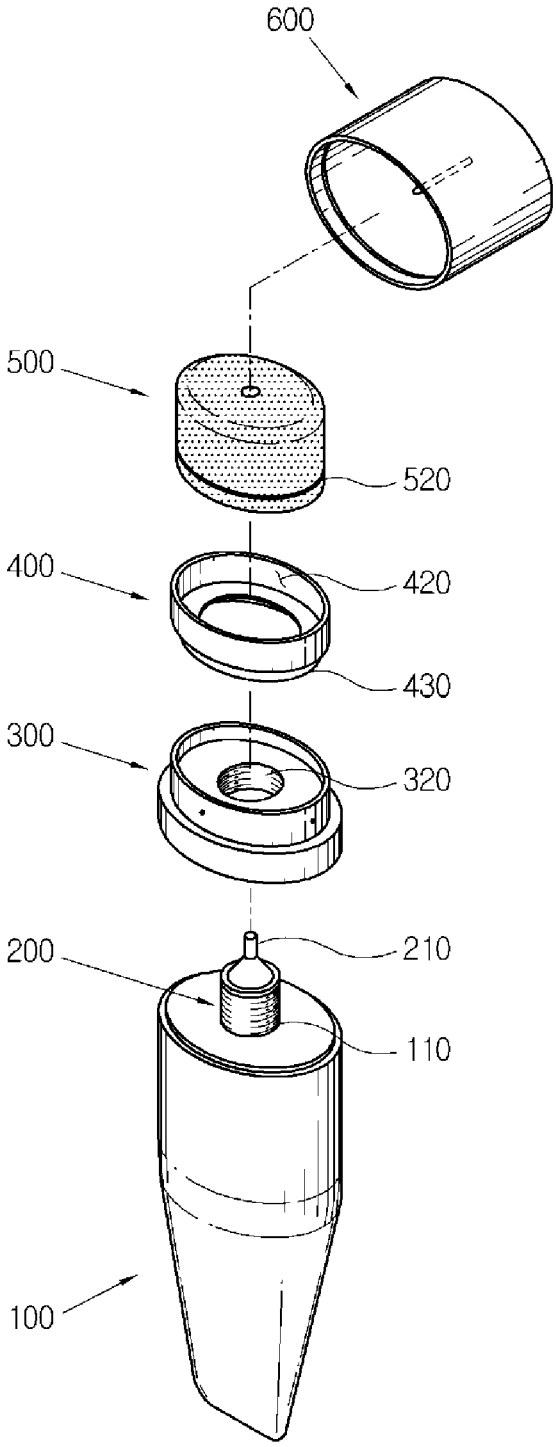
FIG. 4 is an exploded perspective view showing an embodiment wherein an application member of the liquid make-up receptacle according to the present invention has an elliptical cross-section.
Figure 5:
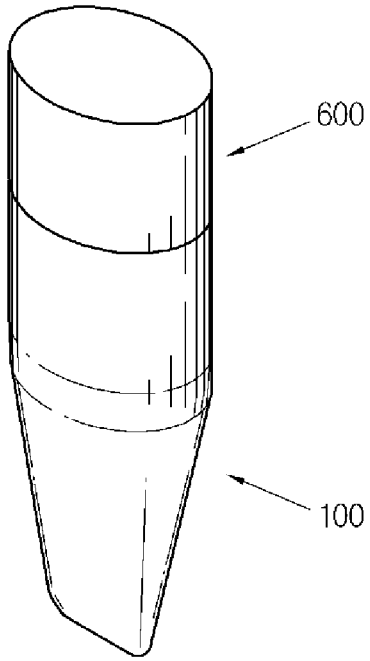
FIG. 5 is a view showing the assembled liquid make-up receptacle of FIG. 4.

As the embodiment related thereto, FIG. 1 shows the case wherein the application member 500 has a circular cross-section, and the shoulder 300, the ring 400 and the cap 600 also have circular cross-sections to correspond to the cross-section of the application member. Further, FIG. 4 shows the case wherein the application member 500 has an elliptical cross-section, and the shoulder 300, the ring 400 and the cap 600 also have elliptical cross-sections to correspond to the cross-section of the application member. Further, it is preferable that a shape of the upper surface of the housing 100 correspond to the cross-section of the application member.

However, the shape of the ring 400 into which the application member 500 is seated will directly correspond to the shape of the cross-section of the application member 500, but the shapes of other components may not correspond to the shape of the cross-section of the application member.

Preferably, the cap 600 according to the present invention has on the upper surface of its inner portion a projection 620, so that the projection 620 is inserted into the through hole 510 of the application member 500 when the cap 600 is closed (see FIGS. 1 and 4).

Moreover, the projection 620 of the cap 600 inserted into the through hole 510 of the application member 500 according to the present invention preferably blocks the discharge protrusion 210 of the discharge part 200. Thus, the discharge of liquid materials through the discharge protrusion 210 is stopped since the projection 620 of the cap 600 blocks the discharge protrusion 210 of the discharge part 200. The discharge protrusion may be blocked by inserting the projection 620 into the discharge protrusion 210 and vice versa. Further, the effect of stopping the discharge is achieved by making the projection come into close contact with the top of the discharge protrusion 210.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A liquid make-up receptacle, comprising:

a housing having an opening at a first end thereof, and holding liquid materials in an inner space thereof;

a discharge part coupled at a first end thereof to the opening of the housing, and having at a second end thereof a discharge protrusion to discharge the materials;

a shoulder, comprising:

a body having a hole in a center thereof;

a lower seating portion provided on a lower portion of the body to be coupled to the housing or the discharge part; and an upper seating portion provided on an upper portion of the body;

a ring, comprising:

a hollow body; and a connecting portion provided on a lower portion of the body and fastened to the upper seating portion of the shoulder;

an application member seated in an application-member seating portion formed in the ring, and having a through hole into which the discharge protrusion of the discharge part is inserted from below; and a cap coupled to the shoulder, whereby a load applied at a time of opening or closing the cap is not directly transmitted to the ring, thus preventing the ring from being detached together with the cap when the cap is opened.

2. The liquid make-up receptacle according to claim 1, wherein the body of the shoulder comprises a cap seating portion having a stepped structure, an outer diameter of a lower end thereof corresponds to an outer diameter of the cap, and an outer diameter of an upper end thereof corresponds to an inner diameter of the cap.

3. The liquid make-up receptacle according to claim 2, wherein a depression member is provided on either of an outer surface of an upper end of the shoulder and an inner surface of the cap which are in contact with each other, and a prominence member is provided on a facing corresponding surface, so that the shoulder and the cap are coupled to each other in a force-fitting manner.

4. The liquid make-up receptacle according to claim 3, wherein the depression member and the prominence member are discontinuously or continuously formed.

5. The liquid make-up receptacle according to claim 2, wherein threaded parts are provided on the outer surface of the upper end of the shoulder and the inner surface of the cap which are in contact with each other, so that the shoulder and the cap are coupled to each other in a threaded manner.

6. The liquid make-up receptacle according to claim 1, wherein an outer surface of the connecting portion of the ring is inserted into and fastened to an inner surface of the upper seating portion of the shoulder, or an outer surface of the upper seating portion of the shoulder is inserted into and fastened to an inner surface of the connecting portion of the ring.

7. The liquid make-up receptacle according to claim 6, wherein a depression member is provided on either of the inner surface of the upper seating portion of the shoulder and the outer surface of the connecting portion of the ring which are in contact with each other, or on either of the outer surface of the upper seating portion of the shoulder and the inner surface of the connecting portion of the ring which are in contact with each other, and a prominence member is provided on a facing corresponding surface, so that the shoulder and the ring are coupled to each other in a force-fitting manner.

8. The liquid make-up receptacle according to claim 6, wherein threaded parts are provided on the inner surface of the upper seating portion of the shoulder and the outer surface of the connecting portion of the ring which are in contact with each other, or on the outer surface of the upper seating portion of the shoulder and the inner surface of the connecting portion of the ring which are in contact with each other, so that the shoulder and the ring are coupled to each other in a threaded manner.

9. The liquid make-up receptacle according to claim 1, wherein a diameter of the application member is formed to be a diameter of the application-member seating portion of the ring or less, so that a surface of the application member is adhered to the application-member seating portion of the ring.

10. The liquid make-up receptacle according to claim 1, wherein a diameter of the application member is formed to be larger than a diameter of the application-member seating portion of the ring, so that the application member is force-fitted into the application-member seating portion.

11. The liquid make-up receptacle according to claim 1, wherein a protrusion is provided on either of an inner surface of the application-member seating portion of the body of the ring and an outer surface of the application member which are in contact with each other, and a groove is provided in a facing corresponding surface, so that the application member is coupled to the application-member seating portion of the ring in a fitting manner.

12. The liquid make-up receptacle according to claim 1, wherein the application member is made of a soft material.

13. The liquid make-up receptacle according to claim 1, wherein the application member has a circular or an elliptical cross-section, and the shoulder, the ring and the cap have a shape which corresponds to a shape of the cross-section of the application member.

14. The liquid make-up receptacle according to claim 1, wherein the cap comprises a projection protruding from an upper surface of an inner portion thereof, so that the projection is inserted into the through hole of the application member when the cap is closed.

15. The liquid make-up receptacle according to claim 14, wherein the projection of the cap inserted into the through hole of the application member blocks the discharge protrusion of the discharge part.

* * * * *